United States Patent [19]

Ruegg et al.

[11] 4,209,120

[45] Jun. 24, 1980

[54] APPARATUS FOR INTERMITTENTLY ADVANCING A SHEET OF INDETERMINATE LENGTH

[75] Inventors: Franz Ruegg, Neuhausen am Rheinfall, Switzerland; Otto Schwarz, Waldshut-Tiengen, Fed. Rep. of Germany

[73] Assignee: Sig Schweizerische Industrie-Gesellschaft, Neuhausen am Rheinfall, Switzerland

[21] Appl. No.: 954,980

[22] Filed: Oct. 26, 1978

[30] Foreign Application Priority Data

Oct. 27, 1977 [CH] Switzerland ..... 13082/77

[51] Int. Cl.[2] ..... B65H 23/18; B65H 17/26

[52] U.S. Cl. ..... 226/32; 226/33; 226/143

[58] Field of Search ..... 226/32, 33, 2, 27, 50, 226/139, 143, 141, 120, 35

[56] References Cited

U.S. PATENT DOCUMENTS

| | | | |
|---|---|---|---|
| 3,371,834 | 3/1968 | Willits | 226/143 X |
| 3,384,281 | 5/1968 | Mason | 226/195 X |
| 3,420,158 | 1/1969 | Kobiella | 226/143 X |
| 3,977,586 | 8/1976 | Hertrich | 226/2 |
| 4,153,190 | 5/1979 | Marion | 226/33 |

*Primary Examiner*—Edward J. McCarthy
*Attorney, Agent, or Firm*—Spencer & Kaye

[57] ABSTRACT

An apparatus for the division-true, intermittent feed of a sheet of indeterminate length has a sheet supply roll; a table for receiving the sheet from the supply roll; a sheet tensioning device disposed between the supply roll and the table; an advancing device for advancing the sheet in each operational cycle through a forward feed stroke that is greater than the divisional distance defined by spaced markings on the sheet; a cutting device for cyclically severing a length from the sheet subsequent to the forward feed stroke; a reversing device for retracting the sheet in each operational cycle through a centering stroke subsequent to the forward feed stroke. The reversing device includes a force-exerting arrangement —constituted solely by the tensioning device—for imparting to the sheet a force for executing the centering stroke, a sensor head cooperating with the moving sheet for responding to the presence or absence of the sheet markings; a solenoid assembly having a solenoid and being connected with the sensor head for changing the state of energization of the solenoid as a function of the response of the sensor head to the sheet markings and an armature cooperating with the solenoid and the sheet for selectively immobilizing or releasing the sheet as a function of the state of energization of the solenoid.

8 Claims, 3 Drawing Figures

APPARATUS FOR INTERMITTENTLY ADVANCING A SHEET OF INDETERMINATE LENGTH

BACKGROUND OF THE INVENTION

This invention relates to an apparatus for the division-true intermittent feed of a sheet of indeterminate length printed with a repetitive design. The sheet is taken from a supply roll and is advanced to a table with the intermediary of a tensioning device. The sheet is, by means of an advancing device, moved in each operational cycle in a forward feed stroke which is greater than the divisional distance and is thereafter pulled back in a centering (correcting) stroke. The apparatus includes a sensor head which responds to markings spaced at the divisional distances on the sheet. The sensor head, as it responds to a marking, energizes or deenergizes a coil which forms part of a solenoid assembly and which is provided with an armature. This arrangement provides that the sheet is cyclically braked and released to stop its motion, or to allow displacement thereof, respectively. There is further provided a knife mechanism for cyclically severing the centered sheet portions.

Apparatuses of the above-outlined type are known and are disclosed, for example, in Swiss Pat. No. 581,560 to which corresponds U.S. Pat. No. 3,977,586. In these known arrangements means are provided to effect a reverse motion (centering or correcting stroke) of the sheet. These means ("pull back organs") have to be driven synchronously with the cycle of the apparatus; this involves substantial structural expense.

SUMMARY OF THE INVENTION

It is an object of the invention to provide an improved apparatus of the above-identified type from which the discussed disadvantages are eliminated.

This object and others to become apparent as the specification progresses, are accomplished by the invention, according to which, briefly stated, the apparatus for the division-true, intermittent feed of a sheet of indeterminate length has a sheet supply roll; a table for receiving the sheet from the supply roll; a sheet tensioning device disposed between the supply roll and the table; an advancing device for advancing the sheet in each operational cycle through a forward feed stroke that is greater than the divisional distance defined by spaced markings on the sheet; a cutting device for cyclically severing a length from the sheet subsequent to the forward feed stroke; a reversing device for retracting the sheet in each operational cycle through a centering stroke subsequent to the forward feed stroke. The reversing device includes a force-exerting arrangement—constituted solely by the tensioning device—for imparting to the sheet a force for executing the centering stroke, a sensor head cooperating with the moving sheet for responding to the pressence or absence of the sheet markings; a solenoid assembly having a solenoid and being connected with the sensor head for changing the state of energization of the solenoid as a function of the response of the sensor head to the sheet markings and an armature cooperating with the solenoid and the sheet for selectively immobilizing or releasing the sheet as a function of the state of energization of the solenoid.

It has been unexpectedly found that, contrary to experts' position taken heretofore, it is feasible to use the tensioning device for causing the sheet to execute the centering stroke and thus, the substantial structural expenses inherent in prior art apparatuses that include "pull back organs" can be saved. Further, such a solution is particularly advantageous with regard to operational safety, speed and wear characteristics.

DESCRIPTION OF THE PREFERRED EMBODIMENTS

Figure 1:
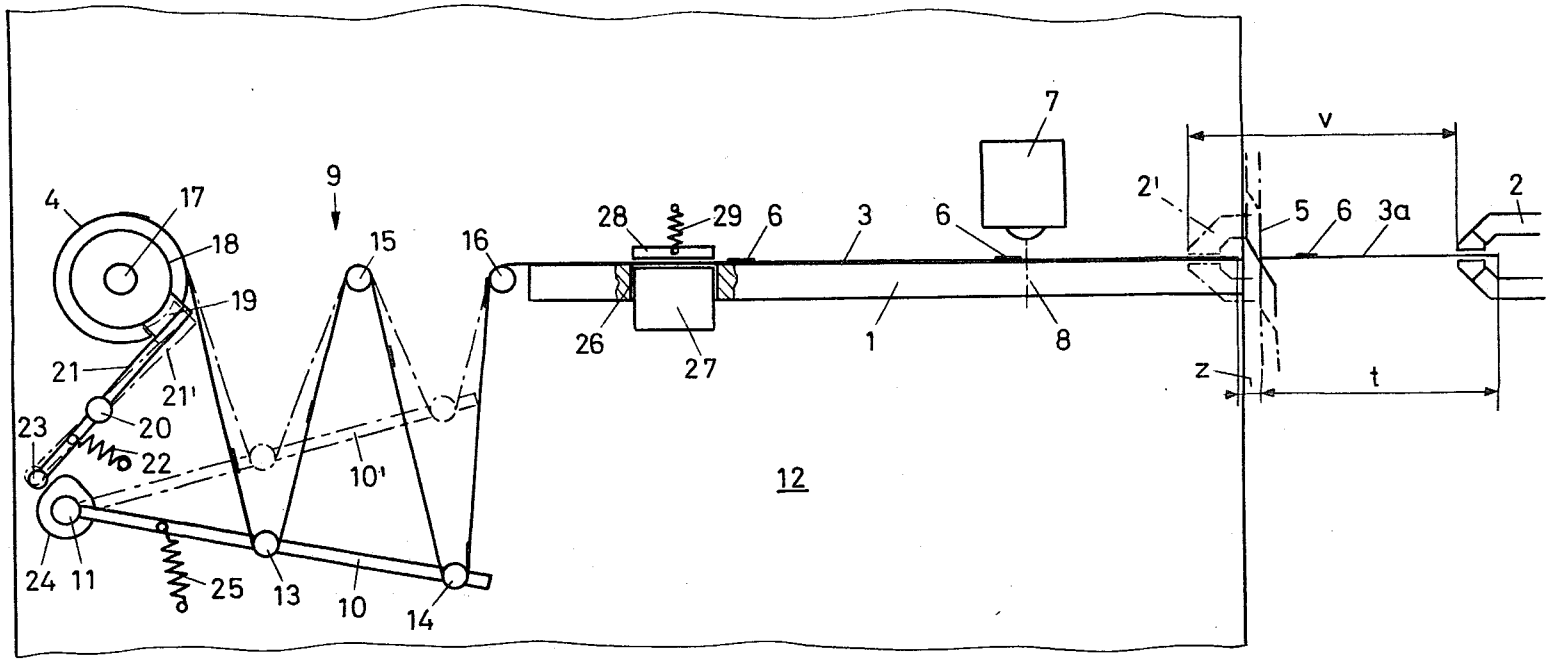
FIG. 1 is a schematic side elevational view of a preferred embodiment of the invention.

Turning to FIG. 1, the apparatus shown therein has a table 1 over which a printed sheet 3 of indeterminate length is pulled by means of sheet clamping jaws 2, preferably having a dual pliers-like structure. The sheet is taken from a supply roll 4. In the vicinity of the discharge (downstream) end of the table 1, there is arranged a cutter 5 which sequentially severs a length portion 3*a* of the sheet 3. The length t of the sheet portion 3*a* corresponds to the length (division) of the repetitive design printed on the sheet. The sheet portions 3*a* serve for packaging articles and the apparatus according to the invention has to ensure that the printed design and/or text on all portions 3*a* are located in the same manner to thus avoid an accumulating effect of constant feeding errors in the length of the sheet portions 3*a*. Thus, the sheet 3 should be cut "division-true" into lengths 3*a*.

For the division-true centering of the sheet portions 3*a* relative to the jaws 2 and the cutter 5, one of the sheet edges carries black markings 6 spaced from one another at the divisional distance t.

In each operational cycle the jaws 2 draw the sheet 3 in a forward feed stroke v which is greater than the divisional distance t. Thereafter the jaws 2 are opened and then, in a manner to be described later, the sheet 3 is retracted in a centering stroke z until the forward edge of the marking 6 of the successive sheet portion 3*a* just reaches a conventional light barrier 8 which comprises a sensor head 7. Thereupon the rearward motion of the sheet 3 is interrupted. Now the cutter 5 is actuated. After removal of the severed sheet 3*a* for admission to a packing machine, the jaws 2 arrive into their dash-dotted pickup position 2', whereupon a new operational cycle begins.

In order to perform the centering stroke z, a tensioning device 9 is utilized which is provided between the supply roll 4 and the inlet (upstream) end of the table 1. The tensioning device 9 includes a pivotal arm 10 which has a pivot shaft 11 supported in a machine frame 12 and horizontal deflecting rods 13 and 14 the length of which corresponds to the width of the sheet 3. To the machine frame 12 there are further secured stationary deflecting rods 15 and 16. The sheet 3 taken from the supply roll 4 is guided in a zigzag manner successively over the rods 13, 15, 14 and 16 prior to its admission to the table 1. On the shaft 17 of the supply roll 4 there is mounted a brake drum 18 which cooperates with a brake shoe 19 which, in turn, is arranged at one end of a lever 21 pivotally supported at 20 on the frame 12. The lever 21 is biased into a "brake actuated" condition by a tension spring 22. At the other end of the lever 21 remote from the brake shoe 19 there is secured a follower 23 cooperating with a control cam 24. The latter is mounted on the pivot shaft 11 of the pivotal arm 10 which, in turn, is urged downwardly into a sheet tensioning position by a tension spring 25. In the full-line position, the follower 23 is situated with a slight clearance next to a lower part of the control cam 24, so that the brake shoe 19 is normally pressed against the brake drum 18 by means of the tension spring 22. When the jaws 2 pull the sheet 3 forwardly, no material can be taken off the immobilized roll 4 and therefore, the length of the zigzag folds of the sheet portion situated between the supply roll 4 and the table 1 is shortened and thus the arm 10 is, by the force exerted by the sheet, pivoted upwardly into the position 10', against the force of the spring 25. At the same time, the control cam 24 also rotates and lifts the follower 23 so that the brake lever 21 moves into the "brake released" position 21', whereupon the supply roll 4 is no longer braked and, as a result, further sheet material may be taken from the supply roll 4 under the effect of the spring 25 which pulls the pivotal arm 10 downwardly into its position shown in full lines in FIG. 1.

Figure 2:
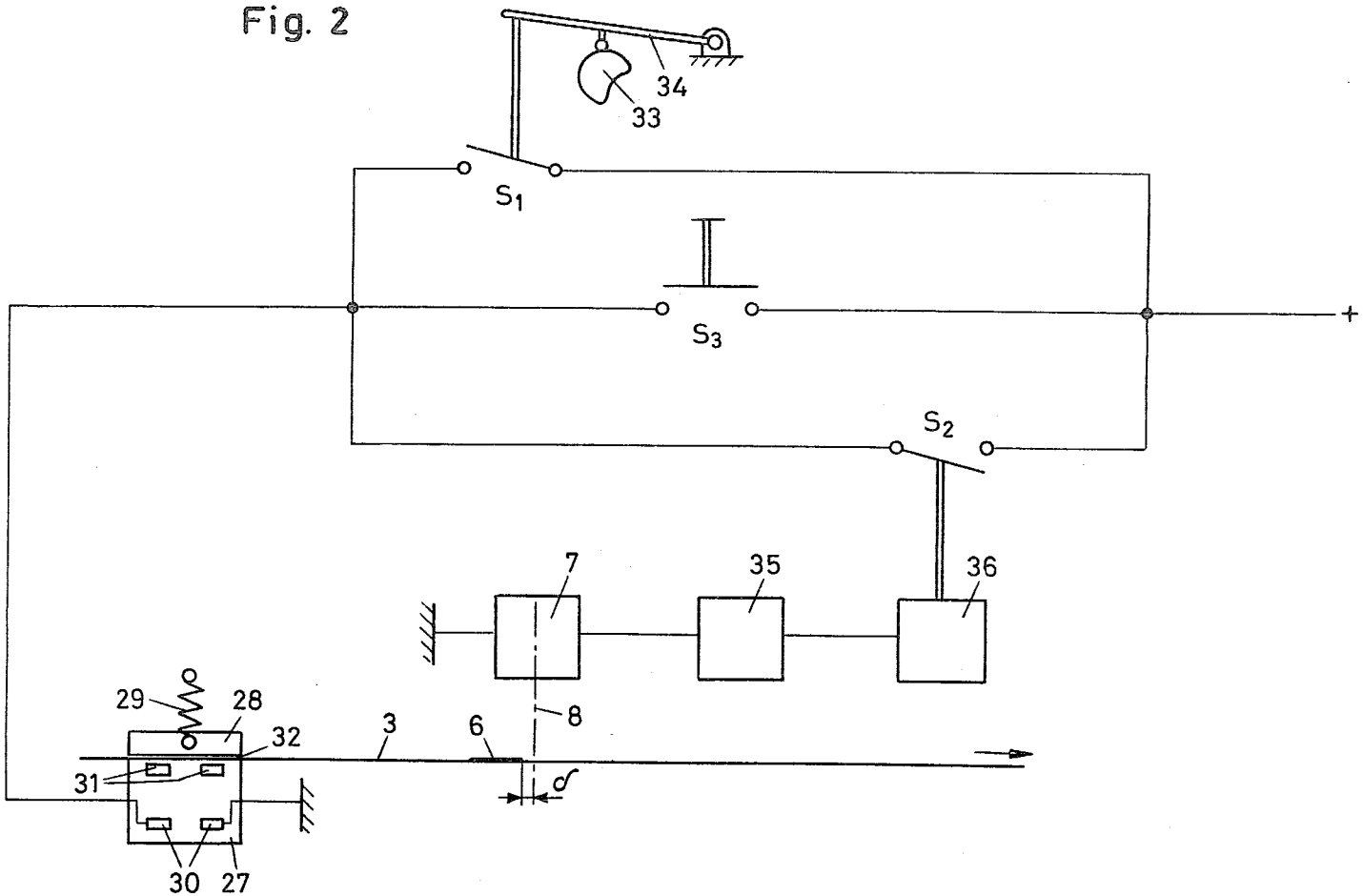
FIG. 2 is a schematic block diagram of the electrical system of the preferred embodiment.

The table 1 has, in the vicinity of its inlet end, a recess 26 which is at equal distances from both longitudinal edges of the table. Within the recess 26 there is secured a solenoid assembly 27, the upper face of which is coplanar with the upper face of the table 1. Above the upper face of the solenoid assembly 27 there is positioned a resiliently suspended armature plate 28 made of a magnetizable material. When the solenoid assembly 27 attracts the armature 28, the sheet 3 is clamped firmly between the upper face of the assembly 27 and the lower face of the armature 28. The assembly 27 which has a body made of a magnetizable material, includes an energizing coil 30 and a permanent magnet 31, as schematically illustrated in FIG. 2. When the coil 30 is energized, the flux generated thereby counteracts the magnetic force of the permanent magnet 31, so that the armature 28 is attracted with a force which is insufficient to overcome the force of the spring 29. As a result, in an energized state of the coil 30, the sheet may move through an open gap 32 formed between the components 27 and 28. In case the coil 30 is in a deenergized state, the permanent magnet 31 attracts the armature 28 with a greater force, so that the sheet 3 is firmly clamped. A solenoid assembly and a cooperating armature of this type are described in more detail in Swiss Patent Application Ser. No. 6566/77.

Turning once again to FIG. 2, between the positive pole of a voltage source and the grounded coil 30 there are provided three circuit breaker switches $S_1$, $S_2$ and $S_3$ connected in parallel. Since all these switches are shown in their open state, the coil 30 is in a deenergized condition and therefore no gap 32 should be present; for the sake of better understanding of the operation, however, the gap 32 is shown to exist.

The switch $S_1$ is maintained in each operational period closed by means of an arm 34 pivoted by a rotating control cam 33 as long as the jaws 2 pull the sheet 3 forwardly in order to permit the execution of the forward stroke.

Figure 3:
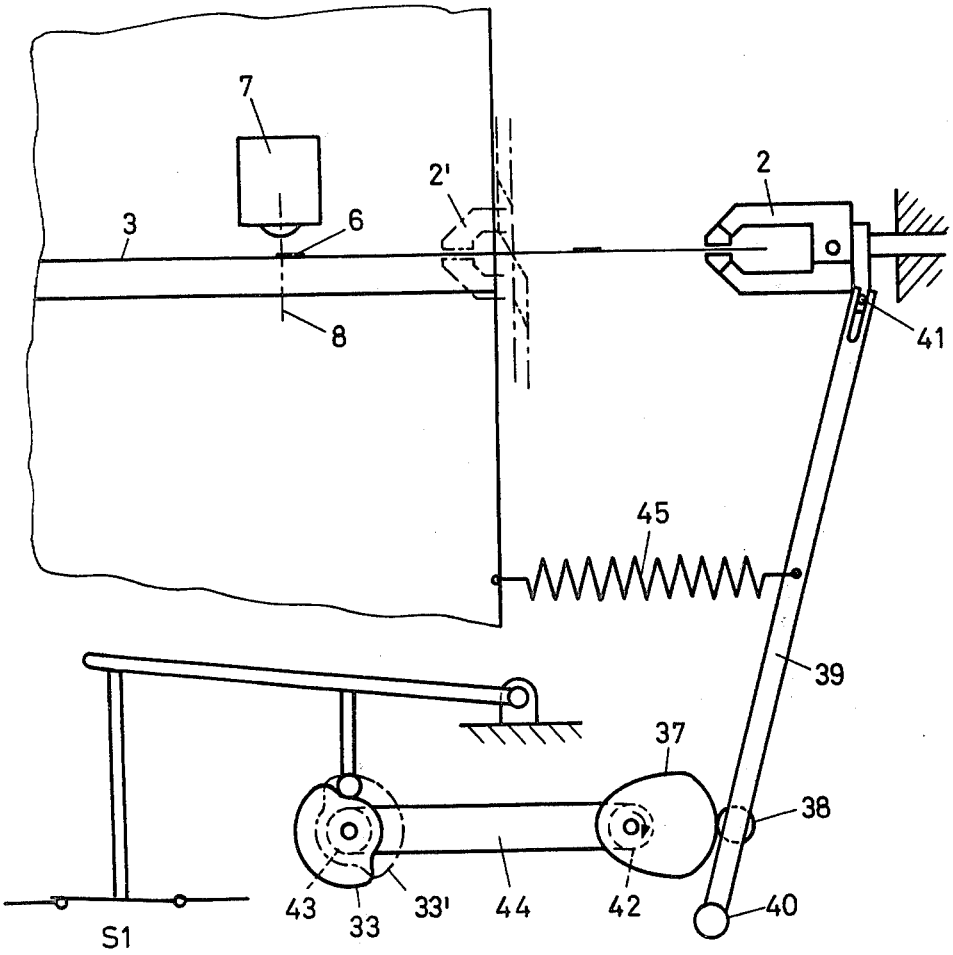
FIG. 3 is a schematic side elevational view of the synchronous drive between jaws and switch.

FIG. 3 shows how a sequence switch cam 37 oscillates the lever 39 around switch axis 40 by means of a roller 38 for displacing the closed jaws 2 and thus the clamped foil 3 into an extreme position to the right, so that the marking 6 may interrupt the light barrier 8. The lever 39 is connected to the jaws 2 by a pin 41. Switch $S_1$ is opened by means of cam 33 which is being driven synchronously with cam 37 by gears 42, 43 and chain 44. When the jaws 2 open again, the foil 3 can move backwards in the gap 32 as long as the marking 6 interrupts the light barrier. The drive of the cam 37 controlled by a packaging machine as well as the drive for opening and closing the jaws 2 are well known techniques in the art and are not shown for simplifying the figure.

After pulling back the opened jaws 2 by means of spring 45 and cam 37 into the pickup position as shown in FIG. 1 (while the switch $S_1$ is open and therefore the foil 3 is clamped by the armature 28) the jaws 2 close. Thereafter cam 37 closes switch $S_1$, whereupon foil 3 is released by the armature 28.

As the light barrier 8 is interruped by a marking 6, the switch $S_2$ is actuated by the sensor head 7 with the intermediary of an amplifier 35 and a relay 36, whereby the switch $S_2$ is closed.

The switch $S_3$ is always open during normal operation. It may be closed manually if, for any reason, for exmaple, at the beginning of the operation, the sheet 3 is to be manually shifted between the components 27 and 28.

When the jaws 2 have completed their forward stroke v from the phantom line position 2' to the solid line position (FIG. 1), they have pulled the sheet 3 farther than shown in FIGS. 1 and 2, so that the light barrier 8 is, by virtue of the position of a marker 6, interrupted and thus the switch $S_2$ is closed. Thus, although the switch $S_1$ is open, the gap 32 still remains, so that the tension generated by the tensioning device 9 causes the sheet 3 to be moved in a reverse direction as soon as the jaws 2 are open.

As soon as the marking 6 has moved backwardly to an extent that its leading edge no longer interrupts the light barrier 8, the switch $S_2$ is opened, whereupon the gap 32 disappears, that is, the armature 28 firmly clamps the sheet 3 against the upper face of the assembly 27.

The very short period necessary for closing the gap 32 provides that upon standstill of the sheet 3, the leading marker edge has a very small constant distance $\delta$ from the light barrier 8. Each new forward stroke of the jaws 2 thus starts from a precisely defined position of the sheet with respect to the design printed thereon. The centering stroke z by which the sheet 3 is pulled backwardly, thus corrects any difference between the feed stroke v and the division t of the design.

It is not indispensable to equip the solenoid assembly 27 with the permanent magnet 31. In case such a permanent magnet is absent, the solenoid assembly 27 attracts the armature 28 when the solenoid 30 is energized. In such a case then the switches $S_1$, $S_2$ and $S_3$ are connected in series—rather than in parallel—between the solenoid 30 and the positive pole of the voltage source. In case any of the switches is open, the coil 30 is not energized and thus the gap 32 is present. In this arrangement the switch $S_1$ is controlled in such a manner that during the forward feed of the jaws 2 it remains open and further, the switch $S_2$ is controlled by the sensor head 7 in such a manner that it opens as soon as the marking 6 interrupts the light barrier 8.

Dash-dotted cam 33' is shaped for switch $S_1$ which is opened during the foreward stroke of jaws 2 and foil 3 may be taken off freely through the gap 32.

Although in the apparatus described and illustrated, the sheet 3 runs between the solenoid assembly 2 and the armature 28, such a solution is also not indispensable. If the solenoid assembly 27 and the armature plate 28 are arranged above the table 1, the armature plate 28 can be rigidly connected with a clamping plate which, by means of springs, firmly clamps the sheet 3 against the table 1 or lifts the sheet therefrom in case the marking 6 interrupts the light barrier, dependent on whether the three switches $S_1$–$S_3$ are arranged in parallel or in series and whether or not the solenoid assembly 27 has a permanent magnet. The illustrated apparatus in which the armature plate 28 itself serves as the clamping plate is a preferred solution because of its simplicity.

The above-described apparatus has superior characteristics regarding operational safety and minimum wear. If, because of a defect in the sheet, a marking 6 is not at its predetermined position, no interruption of the operation will occur; instead, merely the respective centering stroke will not be executed. This results in a correspondingly larger centering stroke for the successive marking.

It is to be understood that the above description of the present invention is susceptible to various modifications, changes and adaptations, and the same are intended to be comprehended within the meaning and range of equivalents of the appended claims.

What is claimed is:

1. In an apparatus for the division-true, intermittent feed of a sheet of indeterminate length having markings thereon spaced at a divisional distance; the apparatus including means supporting a sheet supply roll; a table for receiving the sheet from the supply roll; a tensioning device disposed between the supply roll and the table and engaging the sheet for tensioning the same; an advancing device for engaging and advancing the sheet in each operational cycle through a forward feed stroke that is greater than the divisional distance; reversing means for retracting the sheet in each operational cycle through a centering stroke subsequent to the forward feed stroke; the reversing means includes a force-exerting means for imparting to the sheet a force for executing the centering stroke, a sensor head cooperating with the moving sheet for responding to the presence or absence of the sheet markings; a cutting device for cyclically severing a length from the sheet; a solenoid assembly having a solenoid and being connected with the sensor head for changing the state of energization of the solenoid as a function of the response of the sensor head to the sheet markings, an armature cooperating with the solenoid and the sheet for selectively immobilizing or releasing the sheet as a function of the state of energization of the solenoid; the improvement wherein said force-exerting means is solely said tensioning device.

2. An apparatus as defined in claim 1, wherein said tensioning device comprises a pivotal arm; at least one first sheet guide rod carried by said pivotal arm; at least one stationarily supported second sheet guide rod; the sheet being trained about said first and second rods in a zigzag fashion; means for urging said pivotal arm in a direction away from said second sheet guide rod for tending to increase the length of the zigzag folds of the sheet; a braking device coupled to said means supporting the sheet supply roll; said braking device having an actuated state for immobilizing the sheet supply roll and a released state for allowing rotation of the sheet supply roll; means for normally maintaining said braking device in the actuated state; and brake release means connected to and moved by said pivotal arm to set said brake device into the released state when said pivotal lever assumes a predetermined position moved thereinto by the force of said advancing device effecting a shortening of the zigzag folds of the sheet during the forward feed stroke thereof.

3. An apparatus as defined in claim 1, wherein said solenoid assembly is embedded in said table and said armature is a plate-shaped member resiliently suspended above said assembly for pressing the sheet against said solenoid assembly as a function of the state of energization of said solenoid.

4. An apparatus as defined in claim 3, wherein said solenoid assembly attracts said armature during the energized state of said solenoid and wherein the improvement further comprises an exciting circuit containing said solenoid; said circuit including first and second circuit breaker switches connected in series; means for opening said first switch during the execution of said forward feed stroke; said second switch being connected to said sensor head for being set into an open state when said sensor head responds to the presence of a sheet marking.

5. An apparatus as defined in claim 4, further comprising a normally closed, arbitrarily openable third circuit breaker switch connected in series with said first and second switches.

6. An apparatus as defined in claim 3, wherein said solenoid assembly comprises a permanent magnet arranged to attract said armature; said solenoid, when energized, counteracting the force of said permanent magnet to render it too weak for effecting a clamping of the sheet by the armature against said solenoid assembly.

7. An apparatus as defined in claim 6, further comprising an exciting circuit containing said solenoid; said circuit including first and second circuit breaker switches connected in parallel; means for closing said first switch during the execution of said forward feed stroke; said second switch being connected to said sensor head for being set into a closed state when said sensor head responds to the presence of a sheet marking.

8. An apparatus as defined in claim 7, further comprising a normally open, arbitrarily closable third circuit breaker switch connected in parallel with said first and second switches.

* * * * *